US006308533B1

(12) United States Patent
Nohlen

(10) Patent No.: US 6,308,533 B1
(45) Date of Patent: Oct. 30, 2001

(54) PROCESS AND APPARATUS FOR THE LOW-TEMPERATURE FRACTIONATION OF AIR

(75) Inventor: Thomas Nohlen, Oberhaching (DE)

(73) Assignee: Linde Aktiengesellschaft, Wiesbaden (DE)

( * ) Notice: Subject to any disclaimer, the term of this patent is extended or adjusted under 35 U.S.C. 154(b) by 0 days.

(21) Appl. No.: 09/570,385

(22) Filed: May 12, 2000

(30) Foreign Application Priority Data

May 12, 1999 (DE) ..... 199 21 949

(51) Int. Cl.[7] ..... F25J 3/02
(52) U.S. Cl. ..... 62/643
(58) Field of Search ..... 62/643, 646, 647, 62/925

(56) References Cited

U.S. PATENT DOCUMENTS 5,426,946 * 6/1995 Corduan et al. ..... 62/22
5,613,374 * 3/1997 Rohde et al. ..... 62/643
5,669,237 * 9/1997 Voit ..... 62/646
5,887,447 * 3/1999 Higginbotham ..... 62/643

* cited by examiner

*Primary Examiner*—William Doerrler
*Assistant Examiner*—Malik N. Drake
(74) *Attorney, Agent, or Firm*—Crowell & Moring LLP

(57) ABSTRACT

The process and the apparatus serve for the low-temperature fractionation of air. Feed air (1) is introduced into a first rectification column (3). A transfer fraction (6, 7) of density ρ is withdrawn in the liquid state from a reservoir (24, 16) within the first rectification column (3), expanded (**14, 14*a*, 18) and fed to a further process step (5, 23). The liquid level in the reservoir (24, 16) is in this case at a first level h1 and is at a first pressure p1. The expanded transfer fraction is fed to the further process step (5, 23**) at a second, higher level h2 (h2 >h1) and at a second, lower pressure (p2 <p1). The difference between the two pressures Δp=p1−p2 is less than the hydrostatic pressure (Phydr=ρ·g·[h2−h1]) caused by a liquid column of the transfer fraction between the first level and the second level:

$$\Delta p = p1 - p2 < \rho \cdot g \cdot [h2 - h1]$$

(g: acceleration due to gravity).

The expansion (14, 14a, 18) is carried out in such a manner that the gas bubbles produced on expansion decrease the density of the transfer fraction to the extent that the pressure difference Δp is sufficient for feeding the transfer fraction to the further process step (5, 23).

6 Claims, 1 Drawing Sheet

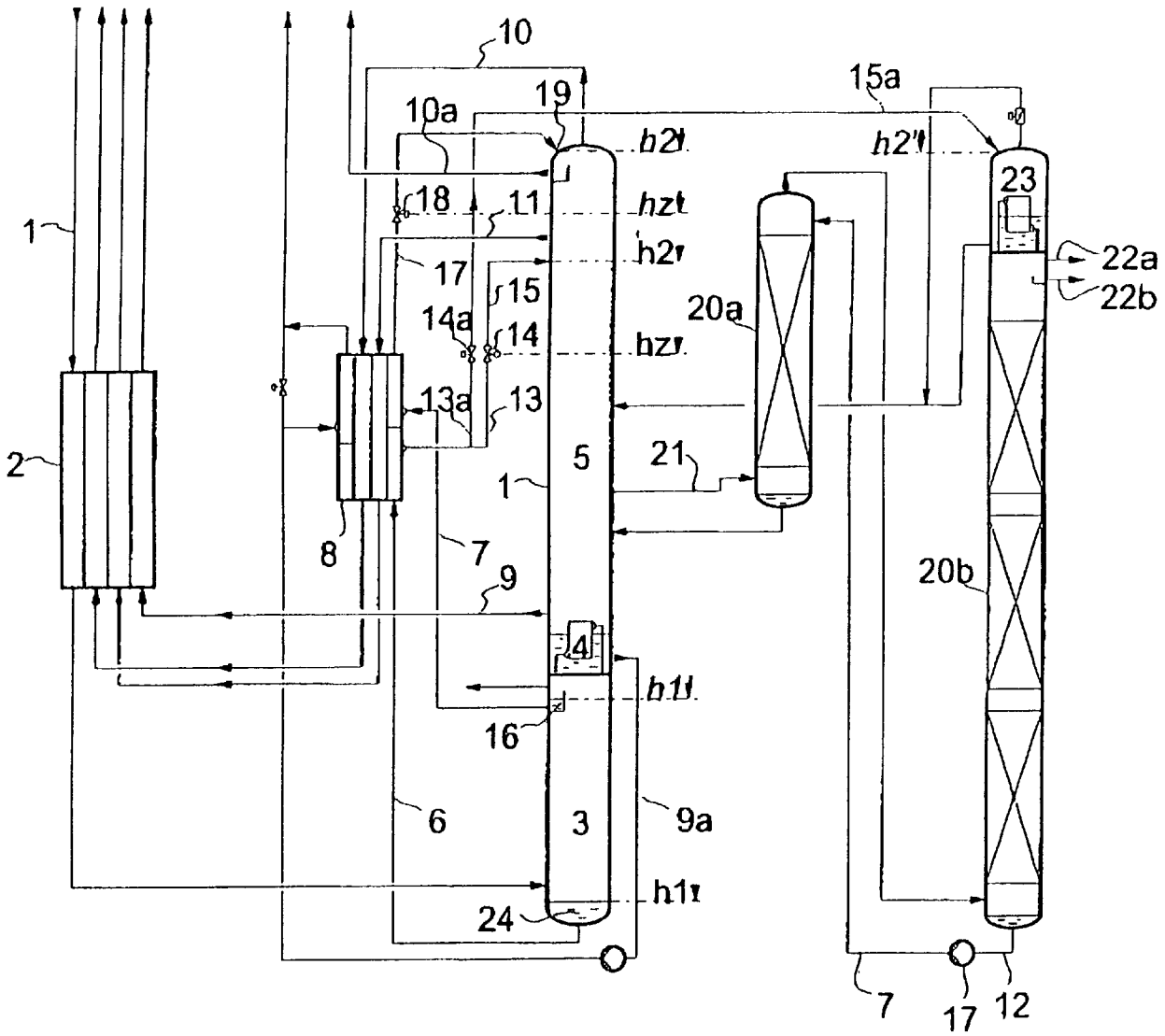
22a
22b
23
12
17
20b
7
15a
h2''
20a
21
h2'
hz'
hz''
h2''
9a
h1''
h1'
5
4
3
19
10
11
15
14
13
1
16
24
10a
18
17
14a
13a
7
9
6
8
1
2

PROCESS AND APPARATUS FOR THE LOW-TEMPERATURE FRACTIONATION OF AIR

BACKGROUND AND SUMMARY OF THE INVENTION

The invention relates to a process for the low-temperature fractionation of air.

Relevant air-fractionation processes and apparatuses are described, for example, in Hausen/Linde, Tieftemperaturtechnik [Cryogenics], 2nd edition 1985, Chapter 4 (pages 281 to 337). The invention relates in particular to two-column or multicolumn systems having a pressure column and having a low-pressure column disposed above the pressure column and/or a multicolumn system having further separation columns for nitrogen-oxygen separation. The pressure column in this case is the "first rectification column" in the meaning of the invention; the rectification in the low-pressure column and/or the vaporization in the top condenser of the crude-argon column is the "further process step". The "transfer fraction" is here formed by the bottoms liquid or an intermediate liquid of the pressure column, which liquid is introduced into the low-pressure column or into the vaporization space of the top condenser of the crude-argon column.

The invention relates in particular to double-column processes, as presented in FIGS. 4.21, 4.23, 4.26, 4.28 and 4.34 in Chapter 4.5 of Hausen/Linde. As a difference from the examples in Hausen/Linde, in the invention, the mass transfer is preferably effected in at least one separation column (e.g. low-pressure column and/or crude-argon column) at least in part by a random packing or arranged packing.

The transfer fraction collects within the first rectification column in a reservoir which is formed by the bottom of this column or a receptacle situated in the column. The liquid level in this reservoir establishes the "first level" h1 in the meaning of the invention. From this reservoir, the transfer fraction is passed into a vessel in which a further process step is carried out, for example the low-pressure column or the vaporization space of a condenser-evaporator (e.g. top condenser of the crude-argon column). The position of the feed to this further process step defines the "second, higher level", in the meaning of the invention.

For some years, the use of low-pressure-drop internals in air fractionation columns has been becoming increasingly widespread, since they have a number of advantages. Air fractionation plants in which packings are used in the low-pressure part of a double column are described, for example, in EP 321163 A, WO 93319335 WO 9319336 or EP 628777 A.

A disadvantage of the use of packings is that the height increases notably compared with tray column. In this case, the inequality quoted in the patent claim can apply, that is to say the pressure difference between pressure column and low-pressure column or between pressure column and evaporation space of the top condenser of the crude-argon column is no longer sufficient in order to overcome the corresponding hydrostatic pressure of a liquid column of the transfer fraction. Whereas this situation can occur in some plants even under normal operating conditions under full load, it frequently appears in particular during special operating cases, in particular during operations under reduced load, that is at lower product and feed rate than under full load operation.

The problem has already been mentioned in principle in EP 567360 A and solved by injecting a "lift gas" downstream of the valve.

The object underlying the invention is further to improve the abovementioned process and the corresponding apparatus.

In the context of the invention it has proved that it is possible to produce the "lift gas" in the meaning of EP 567360 A directly from the transfer fraction itself. The disadvantages of the method described in BP 567360 A are avoided in this case, in particular, in the transfer of oxygen-enriched liquid from the pressure column, neither is consumption of pressurized air as "lift gas" nor are complex additional steps for producing "lift gas" from the transfer fraction necessary; an additional controller is also dispensed with.

For this, a disposition of the expansion valve on a suitable intermediate level between the first and second level is required. The specific establishment of this intermediate level is different for each specific embodiment of the invention, but it can be determined without problem using calculation tools which are available to those skilled in the art, if the height of the intermediate level is given as a degree of freedom. In typical cases, the expansion valve is at an intermediate level of $$hz = h1 + x \cdot (h2 - h1),$$

where x is 30 to 80%, preferably 40 to 70%.

The plant must be designed for a defined operating case. for example for starting up the plant. In another example, the disposition of the expansion valve is designed for the low-load case in steady-state operation of the plant; then, in some circumstances, additional means must be provided for transporting the transfer liquid to the "further process step" during the start-up of the plant; in this case, conventional methods for transporting liquid (mechanical pump, injection of external gas etc.) can be used, alternatively or additionally, the pressure level in the first rectification column can be increased during start-up.

In the process of the invention it is expedient if the transfer fraction is subcooled by indirect heat exchange upstream of the expansion. As a result the formation of a two phase mixture upstream of the expansion is wholly or partially avoided, so that the specific vapour bubble formation of the invention does not take place until during expansion. The subcooling is generally performed in the vicinity of the first level.

Preferably, subcooling is performed just so intensively that the transfer fraction, immediately upstream of the expansion, is completely, or essentially completely, present in liquid form, but is not subcooled further.

In the design of a plant, this is carried out in practice in such a manner that the subcooling is firstly established. The extent of the subcooling of the transfer fraction is generally determined independently of the liquid transport process and is determined by other criteria, for example the aim of producing relatively little flash gas during injection into the second vessel. The expansion operation, in particular the disposition of the expansion valve, is then determined in such a manner that during the predetermined subcooling the transfer fraction is just still present in a single-phase liquid state immediately upstream of the expansion and neither significant subcooling nor vapour bubbles are present to a significant extent.

The invention further relates to an apparatus for the low-temperature fractionation of air.

BRIEF DESCRIPTION OF THE DRAWING

The invention and further details of the invention will be described in more detail below with reference to an embodiment represented schematically in the drawing. In the embodiment, both the transfer of pressure-column bottoms liquid and pressure-column nitrogen into the low-pressure column and the production of argon with transfer of pressure-column bottoms liquid to the top condenser of a crude-argon column are shown.

DETAILED DESCRIPTION OF THE DRAWING

In the process represented in the diagram, purified air 1 at a pressure of 4 to 20 bar, preferably 5 to 12 bar, is cooled to about dew point against product streams in a heat exchanger 2 and injected into the pressure column 3 of a two-stage rectification device. The pressure column 3 is in heat-exchange connection with a low-pressure column 5 via a shared condenser-evaporator 4.

Bottoms liquid 6 and nitrogen 7 are taken off from the pressure column 3, subcooled in a counter-current flow heat exchanger 8 and throttled at least in part into the low-pressure column 5. From the low-pressure column, oxygen 19, nitrogen 10 and impure nitrogen 11 are withdrawn in the gaseous state. The products can also be withdrawn at least in part in the liquid state (oxygen 9*a*, nitrogen 10*a*).

In the pressure column, the bottom forms a reservoir 24 for the column liquid flowing out from the lowest mass transfer section. The bottoms liquid which collects in this reservoir forms the transfer fraction in the meaning of the invention. The "first level" h1 is determined by the liquid level in the bottom of the pressure column. The transfer fraction 6 is subcooled in the countercurrent flow heat exchanger 8. The subcooled transfer fraction flows in a first part 13 to an expansion valve 14 which is disposed at the level hz. During the expansion 14 sufficient vapour is generated such that the remaining pressure difference is sufficient to force the transfer fraction as a two-phase mixture 15 into the low-pressure column, more precisely to the "second level" h2. In a specific numerical example the following apply:

h1=3100 mm h2=22,100 mm hz=46,100 mm

The method of the invention of transferring a liquid can equally be applied to the liquid nitrogen 7 from the top of the pressure column as (further) "transfer fraction". The "first level" in this case is formed by the liquid level within the receptacle 16 in which the liquid coming from the main condenser 4 is collected. Subcooling is again carried out in the countercurrent flow heat exchanger 8. The subcooled nitrogen 17 flows to an expansion valve 18 which is disposed at an intermediate level hz' and finally flows further to the infection position 19 ("second level"h2') at the top of the low-pressure column.

It argon is additionally produced, as represented in the drawing, the invention can also be applied to the transport of a liquid transfer fraction to the vaporization space of the top condenser of a crude-argon column. The crude-argon column is formed in the example by two sections 20*a*, 20*b*, whose function is described extensively in European Patent EP 628777 B1 and the corresponding U.S. Pat. No. 5,426,946. The invention can be used in any known type of crude argon production in which an argon-containing oxygen fraction 21 is passed from the low-pressure column 5 into a crude-argon column, an oxygen-depleted argon product 22*a*, 22*b* being produced in the gaseous and/or liquid state in the upper region of the crude-argon column.

The further transfer fraction is formed, in the example represented in the drawing, by a part 13*a* of the subcooled bottoms liquid 6 from the pressure column 3. It is expanded in an expansion valve 14*a* which is disposed at an intermediate level. This intermediate level is, in the example, at the same height, or about the same height, as the intermediate level hz. The transfer fraction 15*a*, from the bottom 24 of the pressure column 3, which is expanded in 14*a* is introduced at a "second level" h2" into the vaporization space 23 of the top condenser of the crude-argon column.

What is claimed is:

1. A process for the low-temperature fractionation of air, comprising:

introduced feed air into a first rectification column;

withdrawing a transfer fraction of density ρ in the liquid state from a reservoir within the first rectification column, wherein a liquid level in the reservoir is at a first level h1 and is at a first pressure p1;

expanding transfer fraction such that gas bubbles produced on expansion decrease the density of the transfer fraction to the extent that the pressure difference Δp is sufficient for feeding the transfer fraction to the further process step;

feeding the expanded transfer fraction to the further process step at a second, higher level h2 (h2 >h1) and at a second, lower pressure (p2<p1), wherein the difference between the two pressures Δp=p1−p2 is less than the hydrostatic pressure (Phydr=ρ·g·(h2−h1) caused by a liquid column of the transfer fraction between the first level and the second level:

$$\Delta p = p1 - p2 < \rho \cdot g \cdot [h2 - h1]$$

(g: acceleration due to gravity).

2. A process according to claim 1, further comprising subcooling the transfer fraction by indirect heat exchange upstream of the expansion.

3. A process according to claim 2, wherein the subcooling is carried out such that the transfer fraction, immediately upstream of the expansion, comprises a liquid.

4. An apparatus for the low-temperature fractionation of air, comprising:

a first rectification column having a reservoir for a liquid transfer fraction;

a liquid line connected to the reservoir in the first rectification column and to a further vessel and comprising an expansion valve;

where:

a liquid level in the reservoir is at a first level h1 and is at a first pressure p1, in the further vessel at the connection point between liquid line and further vessel a second pressure (p2) prevails in the operating case, the connection point between liquid line and further vessel is disposed at a second, higher level h2 (h2>h1), the difference between the two pressures Δp=p1−p2 in the operating case is less than the hydrostatic pressure (Phydr=ρ·g·(h2−h1) caused by a liquid column of the transfer fraction between the first level and the second level:

$$\Delta p = p1 - p2 < \rho \cdot g \cdot (h2 - h1)$$

(g: acceleration due to gravity wherein the expansion valve is disposed such that gas bubbles produced on expansion decrease the density of the transfer fraction during the expansion to the extent that the pressure difference $\Delta p$ is sufficient for feeding the transfer fraction to the further vessel.

5. An apparatus according to claim 4, further comprising a heat exchanger for cooling the transfer fraction by indirect heat exchange disposed in the liquid line upstream of the expansion valve.

6. An apparatus according to claim 5, wherein the heat exchanger is disposed so that the transfer fraction, immediately upstream of the expansion valve, comprises a liquid.

* * * * *